United States Patent [19]

Schroeder

[11] Patent Number: 4,792,747

[45] Date of Patent: Dec. 20, 1988

[54] LOW VOLTAGE DROPOUT REGULATOR

[75] Inventor: James E. Schroeder, Garland, Tex.

[73] Assignee: Texas Instruments Incorporated, Dallas, Tex.

[21] Appl. No.: 68,979

[22] Filed: Jul. 1, 1987

[51] Int. Cl.[4] ..... G05F 5/00

[52] U.S. Cl. ..... 323/303; 323/274

[58] Field of Search ..... 323/274, 275, 276, 268, 323/269, 299, 303

[56] References Cited

U.S. PATENT DOCUMENTS 4,543,522 9/1985 Moreau ..... 323/303

4,613,809 9/1986 Skovmand ..... 323/303 X

FOREIGN PATENT DOCUMENTS 1434170 5/1976 United Kingdom ..... 323/303

*Primary Examiner*—Peter S. Wong

*Attorney, Agent, or Firm*—Michael E. Melton; Thomas W. DeMond; Melvin Sharp

[57] ABSTRACT

A high efficiency dropout regulator (60) drives an output transistor (22) with a PNP transistor (52) if the overhead voltage from input (14) to output (26) is below a predetermined voltage. If the overhead voltage exceeds the predetermined voltage, then a second PNP transistor (64) and an NPN transistor (72) are used to drive the output transistor (22), resulting in a large reduction of power loss. The current drawn from the output transistor (22) by the NPN transistor (72) is returned to the output.

14 Claims, 1 Drawing Sheet

PRIOR ART

LOW VOLTAGE DROPOUT REGULATOR

TECHNICAL FIELD OF THE INVENTION

This invention pertains in general to low dropout regulators, and more particularly to a method and apparatus providing a low dropout regulator with high energy efficiency.

BACKGROUND OF THE INVENTION

Low dropout regulators generate a regulated voltage output using a low voltage overhead between input and output. In a low dropout regulator, the input voltage may be as low as one volt above the regulated output voltage, making it suitable for use in applications where high voltage overheads are not available.

In order for integrated circuit low dropout regulators to function with a low voltage overhead, a PNP transistor is used as the output structure to conduct current to the output load. Since the PNP transistor is a low beta transistor, up to forty percent of the power delivered to the regulator may be wasted for quiescent biasing under a full load on the regulator. This power loss can result in excessive heating of the regulator and of the circuit board.

Presently, the power loss associated with the PNP transistor is reduced by optimizing the output transistor efficiency at a set load current by area scaling the output transistor. Whereas this technique works for specialized applications, it requires designing a new regulator for each minor application change. Furthermore, the solution does not prevent the waste of input power or the excessive regulator and board heating.

Therefore, a need has arisen for an integrated circuit low dropout regulator which efficiently utilizes the input power to reduce power loss and undesirable heating.

SUMMARY OF THE INVENTION

The present invention disclosed and claimed herein describes a method and apparatus for generating a regulated voltage output which substantially eliminates problems associated with prior low dropout regulator circuits In one aspect of the invention, a low dropout regulator circuit is disclosed which comprises two control circuits for controlling an output transistor operable to conduct a current between an input and an output. The first control circuit controls the current through the first transistor in instances where the input voltage exceeds the desired regulated voltage by less than a predetermined voltage The second control circuitry controls the current through the first transistor in instances where the input voltage exceeds the desired voltage by more than the predetermined voltage. The second control circuitry takes advantage of a high efficiency NPN transistor to return the PNP base current back to the load when sufficient overhead is available.

This aspect of the invention allows the low dropout regulator to operate in high efficiency manner during periods where sufficient overhead is available to drive the NPN transistor. In periods where the regulator must operate with low voltage overhead, the regulator operates as a normal low dropout regulator. This aspect of the invention conserves a considerable portion of the power presently dissipated in the regulator, and reduces excessive regulator and board heating.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
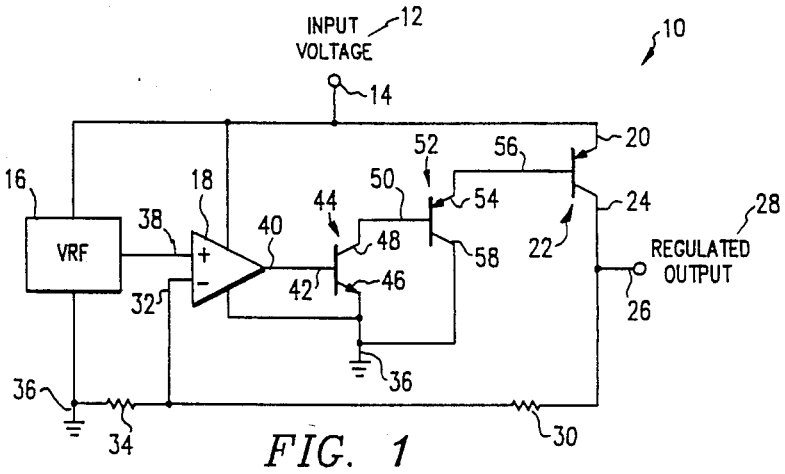
FIG. 1 illustrates a previously developed low dropout regulator.
Figure 2:
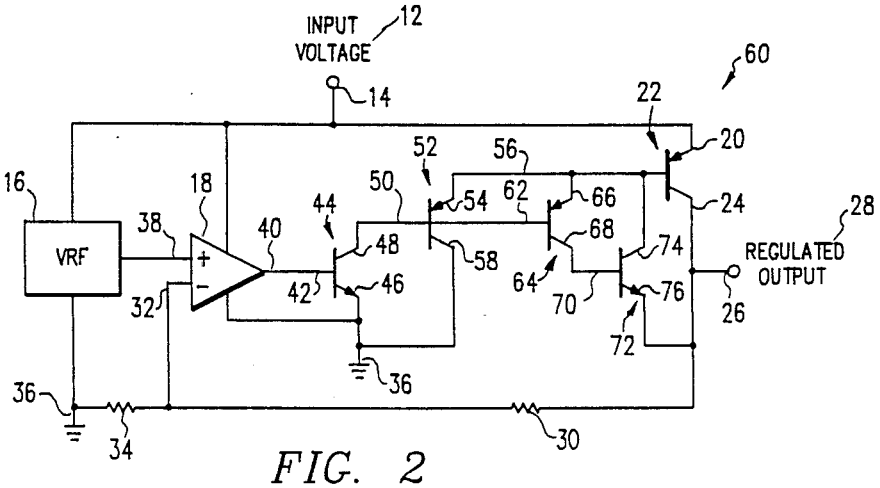
FIG. 2 illustrates the low dropout regulator of the present invention.

The preferred embodiment of the present invention is best understood by referring to FIGS. 1 and 2 of the drawings, like numerals used for corresponding parts of the drawings FIG. 1 illustrates a prior art low dropout regulator 10. An input voltage 12 is connected to an input node 14. The input node 14 is connected to a voltage reference 16, to an op amp 18 used as a differential amplifier, and to the emitter 20 of a PNP output transistor 22. The collector 24 of the PNP output transistor 22 is connected to output node 26 at which the regulated output 28 is generated. The output node 26 is connected to a lead of a first resistor 30. The other lead of the first resistor 30 is connected to the inverting input 32 of the op amp 18 and to a second resistor 34. The other lead of the second resistor 34 is connected to ground 36, as is the voltage reference 16. The output of the voltage reference 16 is connected to the noninverting input 38 of the op amp 18. The output 40 of the op amp 18 is connected to the base 42 of an NPN transistor 44. The emitter 46 of the NPN transistor 44 is connected to ground 36. The collector 48 of the NPN transistor 44 is connected to the base 50 of an PNP transistor 52. The emitter 54 of the PNP transistor 52 is connected to the base 56 of the PNP output transistor 22. The collector 58 of the PNP transistor 52 is connected to ground 36. The ground pin of the op amp 18 is also connected to ground 36.

The output transistor 22 is a large power PNP output structure having a conventional design. Current passed through the output transistor 22 is conducted through first and second resistor 30 and 34 which act as a voltage divider. The voltage across the second resistor 34 is compared with the voltage reference 16 using the op amp 18 as an comparator. The reference voltage may be supplied by a zener reference, band-gap transistor, or other means as known to those skilled in the art. The op amp 18 produces a signal which drives the NPN transistor 44. Hence, if the regulated output 28 dips below the desired value as indicated by comparison of the voltage reference 16 with the voltage across the second resistor 34, then the NPN transistor 44 will be driven harder.

As the op amp 18 supplies the base 42 of the NPN transistor 44 with more current, causing an increase in the current conducted from collector 48 to emitter 46. Since the collector 48 is connected to the base 50 of the PNP transistor 52, the additional current passed through the transistor 44 causes a proportional increase of the current passed through the PNP transistor 52 from emitter 54 to collector 58.

The PNP transistor 52 and output transistor 22 form a PNP Darlington pair. The base 56 of the output transistor 22 is connected to the emitter 54 of the PNP transistor 52; thus, the increase in current through the PNP transistor 52 causes greater current to be drawn from the base 56, driving the PNP output transistor 22 harder, thereby increasing current therethrough. The increased current is conducted through the resistors 30 and 34, increasing the output voltage. The increased voltage is fed back through the differential amplifier, further regulating the output 28.

As can be seen in FIG. 1, the current drawn from the base 56 of the output transistor 22 is conducted through the PNP transistor 52 to ground 36. This conduction of input power to ground is an inefficient use of power, and creates excessive heat which is detrimental to the regulator chip and the board.

Much of the problem is attributable to the relatively poor performance of the PNP transistors 22 and 52. A PNP transistor has a beta of approximately one-fifth of an NPN transistor, resulting in low efficiency. The PNP transistor is used, however, because only one volt is needed to drive the PNP transistor to conduct current through the output resistors 30 and 34. Whereas an NPN Darlington pair could be used in place of the PNP Darlington pair, such a structure would require two and one-half volts overhead in order to regulate the output.

The high efficiency dropout regulator 60 of the present invention is illustrated in FIG. 2. The high efficiency dropout regulator 60 has a structure similar to the low voltage dropout regulator 10 previously discussed in connection with FIG. 1, with the addition of a NPN/PNP transistor pair. In the high efficiency dropout regulator 60, the collector 48 of the NPN transistor 44 is connected to the base 62 of a PNP transistor 64 in addition to the base 50 of the PNP transistor 52. The emitter 66 of the PNP transistor 64 is also connected to the base 56 of the output transistor 22. The collector 68 of the PNP transistor 64 is connected to the base 70 of an NPN transistor 72. The collector 74 of the NPN transistor 72 is connected to the base 56 of the output transistor 22 and the emitter 76 of the NPN transistor 72 is connected to the collector 24 of the output transistor 22, the output node 26 and the first resistor 30.

The high efficiency dropout regulator 60 operates in two separate modes. The first mode of operation occurs when the voltage difference between the input voltage 12 and the regulator output voltage 28 is between 0.6 volts and 1.8 volts. With less than 1.8 volts overhead, the voltage across the output transistor 22 will be insufficient to bias the NPN transistor 72 from emitter-to-base (approximately 0.7 volts needed), the PNP transistor 64 from collector-to-emitter (approximately 0.4 volts needed in saturation), and the output transistor 22 from base-to-emitter (approximately 0.6 volts needed). Consequently, the NPN transistor 72 and the PNP transistor 64 will be rendered nonconductive. Therefore, the circuit will operate in the manner described in connection with FIG. 1, with the NPN transistor 44 driving the PNP transistor 52, which draws current from the base of the output transistor 22.

With a voltage overhead of greater than 1.8 volts, the high efficiency dropout regulator 60 operates in a second mode of operation. The voltage across the output transistor 22 is sufficient to bias the NPN transistor 72, the PNP transistor 64, and the output transistor 22. Hence, NPN transistor 44 will conduct current in response to an output from the op amp 18, rendering PNP transistor 64 conductive. The current conducted through PNP transistor 64 drives the NPN transistor 72, having a beta of approximately 100. Therefore, the NPN transistor 72 will conduct 100 times the current that the PNP transistor 64 conducts In an important advantage of the invention, the current drawn from the base 56 of the PNP output transistor 22 is conducted back to the output, thus conserving power. Furthermore, the heat generated by the large current to ground is substantially reduced. Since the high efficiency regulator 60 is working at highest efficiency during a high input voltage, when the highest regulator power dissipation occurs in previously developed dropout regulators, up to 25% of the power presently dissipated in the regulator may be conserved.

As the voltage difference between the input voltage 12 and the regulated output voltage 28 diminishes, the base of the PNP transistor 64 must be driven with more current, thereby increasing its emitter-to-base voltage. The increased emitter-to-base voltage of the PNP transistor 64 progressively pushes the emitter-base voltage of the PNP transistor 52 towards the active region of its operation. As the input voltage decreases below the ability of the PNP transistor 64 to approach saturation, the base-emitter junction of the NPN transistor 72 becomes reverse biased and turns off. At this time, the PNP transistor 52 is completely controlling the base bias of the output transistor 22. This provides for a smooth transition between operating modes of the high efficiency dropout regulator 60.

The sizes of the transistors used in the high efficiency dropout regulator 60 will depend upon the current density required, as would be known to one skilled in the art. By increasing the size of the high efficiency mode transistors 64 and 72, the necessary overhead may be reduced.

Although a preferred embodiment of the present invention has been described in detail, it should be understood that the various changes, substitutions and alterations can be made therein without departing from the spirit and scope of the invention as defined by the appended claims.

What is claimed is:

1. A low dropout regulator for generating a desired output voltage comprising:

an input for receiving an input voltage in excess of the desired output voltage;

an output for generating the desired output voltage;

a first current control element operable to conduct a current between said input and said output;

first control circuitry for controlling the current through said first current control element when said input voltage exceeds the desired output voltage by less than a predetermined voltage; and second control circuitry including a NPN transistor for controlling the current through said first current control element when said input voltage exceeds said desired output voltage by at least said predetermined voltage.

2. The regulator of claim 1 wherein said first current control element comprises a first transistor operable to conduct current in response to current drawn from the base of said first transistor.

3. The regulator of claim 2 wherein said second control circuitry draws current through the base of said first transistor, some of said drawn current being conducted to said output.

4. The regulator of claim 3 wherein said NPN transistor is operatively connected to conduct current between the base of said first transistor and said output.

5. The regulator of claim 4 wherein said second control circuitry further comprises a third transistor conducting current between said first transistor and the base of said NPN transistor.

6. The regulator of claim 1 and further comprising differential circuitry for generating a difference signal corresponding to the voltage difference between the desired voltage and the actual voltage output.

7. The regulator of claim 6 wherein said differential circuitry drives said first control circuitry and said second control circuitry.

8. The regulator of claim 1 and further comprising an output load connected to said output.

9. The regulator of claim 8 wherein said output load comprises two resistors operable as a voltage divider and further comprising:

circuitry to generate a reference voltage; and differential circuitry for subtracting said reference voltage from the voltage across one of said resistors.

10. The regulator of claim 9 wherein said reference voltage circuitry comprises a zener diode.

11. A low dropout regulator for generating a desired voltage comprising:

an input for receiving an input voltage;

an output operable to supply the desired voltage;

an output transistor operable to conduct current between said input and said output;

a first driving transistor for driving said output transistor by drawing current from the base of said output transistor and supplying said drawn current to the output;

differential circuitry for generating a voltage corresponding to the voltage present at said output;

a second driving NPN transistor operable to drive said first driving transistor in response to said differential voltage when said input voltage exceeds said output voltage by more than a predetermined voltage; and a third driving transistor operable to drive said output transistor in response to said differential voltage when the voltage difference from said input to output does not exceed said predetermined voltage.

12. A method of generating a desired output voltage in a voltage regulator comprising the steps of:

receiving an input voltage from an input;

conducting current from said input to an output;

controlling the amount of current conducted from input to output with a first control circuit if said input voltage exceeds the desired output voltage by less than a predetermined voltage; and controlling the amount of current conducted from said input to said output with a second control circuit including an NPN transistor if said input voltage exceeds the desired output voltage by at least said predetermined voltage.

13. The method of claim 12 wherein said second control circuit controls said current by drawing current from an output transistor.

14. The method of claim 13 and further comprising the step of conducting said current drawn from the output transistor to the output in order to increase energy efficiency.

* * * * *